United States Patent [19]

Paul

[11] 4,073,176

[45] Feb. 14, 1978

[54] PIERCING AND FLANGING APPARATUS

[76] Inventor: William A. Paul, 1808 Parkside Blvd., Toledo, Ohio 43607

[21] Appl. No.: 760,629

[22] Filed: Jan. 19, 1977

[51] Int. Cl.[2] ..... B21D 37/12; B21D 45/00

[52] U.S. Cl. ..... 72/328; 83/82; 83/623

[58] Field of Search ..... 72/327, 328; 83/82, 83/623

[56] References Cited

U.S. PATENT DOCUMENTS

| | | | |
|---|---|---|---|
| 2,594,506 | 4/1952 | Sharpe | 83/623 |
| 2,701,018 | 2/1955 | Glitsch | 72/328 |
| 2,758,652 | 8/1956 | Novinger et al. | 83/82 |
| 3,893,358 | 7/1975 | Dixon | 83/82 |

*Primary Examiner*—Lowell A. Larson

*Attorney, Agent, or Firm*—Allen D. Gutchess, Jr.

[57] ABSTRACT

Apparatus is provided for piercing and flanging a metal workpiece. The apparatus includes a punch and a back-up die with the punch driven by a hydraulic ram. The punch, die, and ram are mounted on a frame which is movably carried by a main support. A workpiece support is affixed to the main support and positions the workpiece between the punch and the die. The ram moves the punch toward and away from the workpiece relative to the frame and also causes the frame to move relative to the workpiece. This arrangement enables the punch and die to seek operative positions relative to the workpiece without the necessity of the workpiece being precisely positioned. The punch and die are also designed to be reversed to provide the opposite operation on the workpiece, if desired.

9 Claims, 8 Drawing Figures

10
12
14
118
114
44
86
122
124
28
88
148
128
58
24
42
76
62
60

10
24
42
72
74
76
62
58
130
128
88
122
164
86
124
166
114
12
14
44

PIERCING AND FLANGING APPARATUS

This invention relates to apparatus for piercing and flanging a workpiece.

The apparatus according to the invention includes a piercing punch and a back-up die. One of them is driven by a ram or other suitable drive and the punch, die, and ram are all mounted on a common frame, the driven punch or die being movably mounted on the frame. The frame is slidably carried by a main support and a workpiece support is affixed to the main support and positions a portion of the workpiece between the punch and die. With this arrangement, the punch or die can be moved against the workpiece by the ram, with continued power supplied by the ram then moving the frame and the other one of the punch and die in the opposite direction until the latter contacts the workpiece. Continued movement then causes the piercing and flanging operation to be effected. This enables proper piercing and flanging to be achieved without the necessity of the workpiece being precisely positioned relative to the die and the punch.

The apparatus also is designed to enable the punch and the back-up die to be reversed to provide piercing and flanging of the workpiece in the opposite direction.

The apparatus also includes a movable discharge chute which receives the slug from the workpiece and which is automatically retracted to clear the workpiece when the operation is completed.

It is, therefore, a principal object of the invention to provide improved apparatus for piercing and flanging metal workpieces.

Many other objects and advantages of the invention will be apparent from the following detailed description of a preferred embodiment thereof, reference being made to the accompanying drawings, in which.

Figure 1:
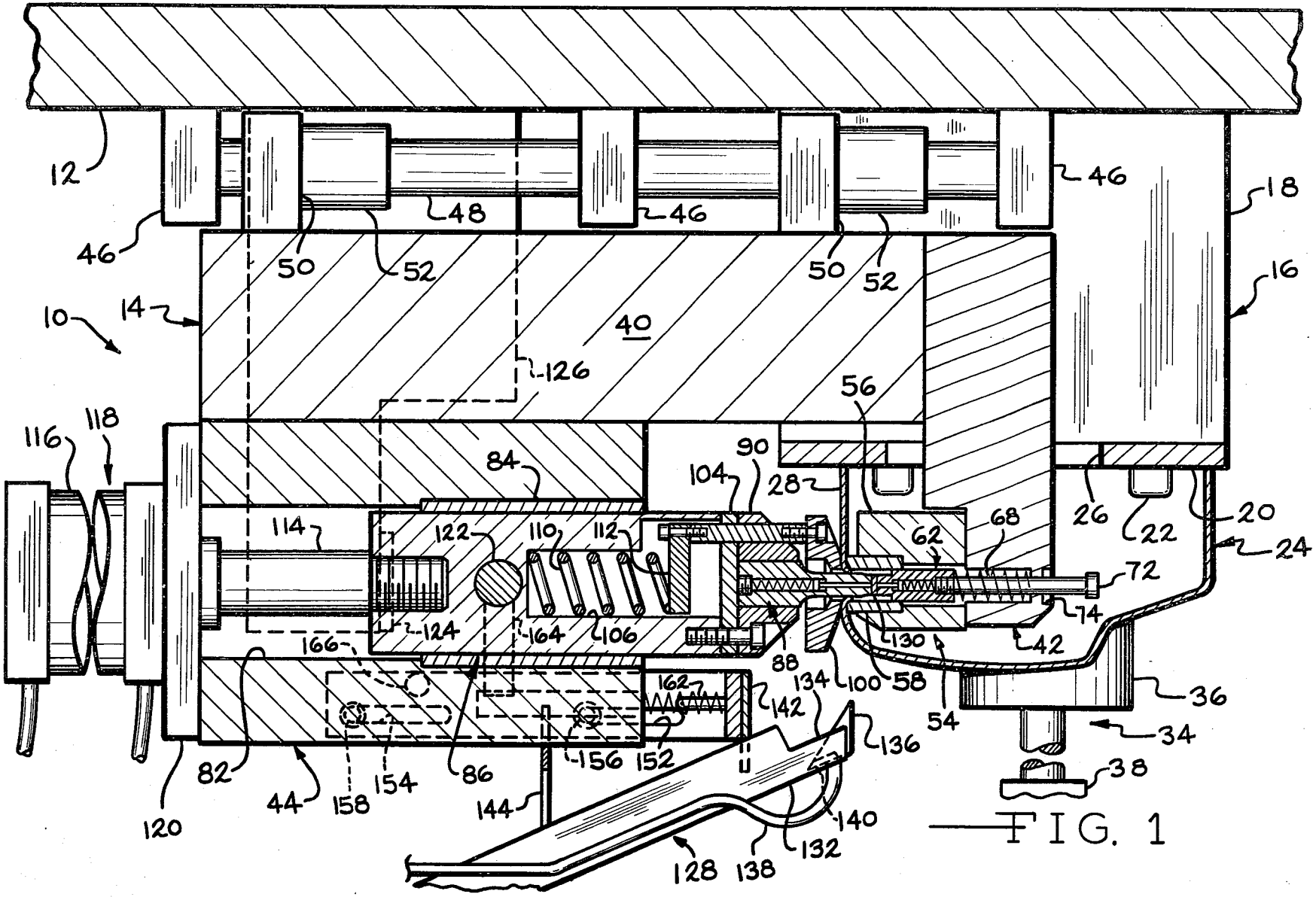
FIG. 1 is a somewhat schematic view in longitudinal cross section of piercing and flanging apparatus according to the invention.
Figure 2:
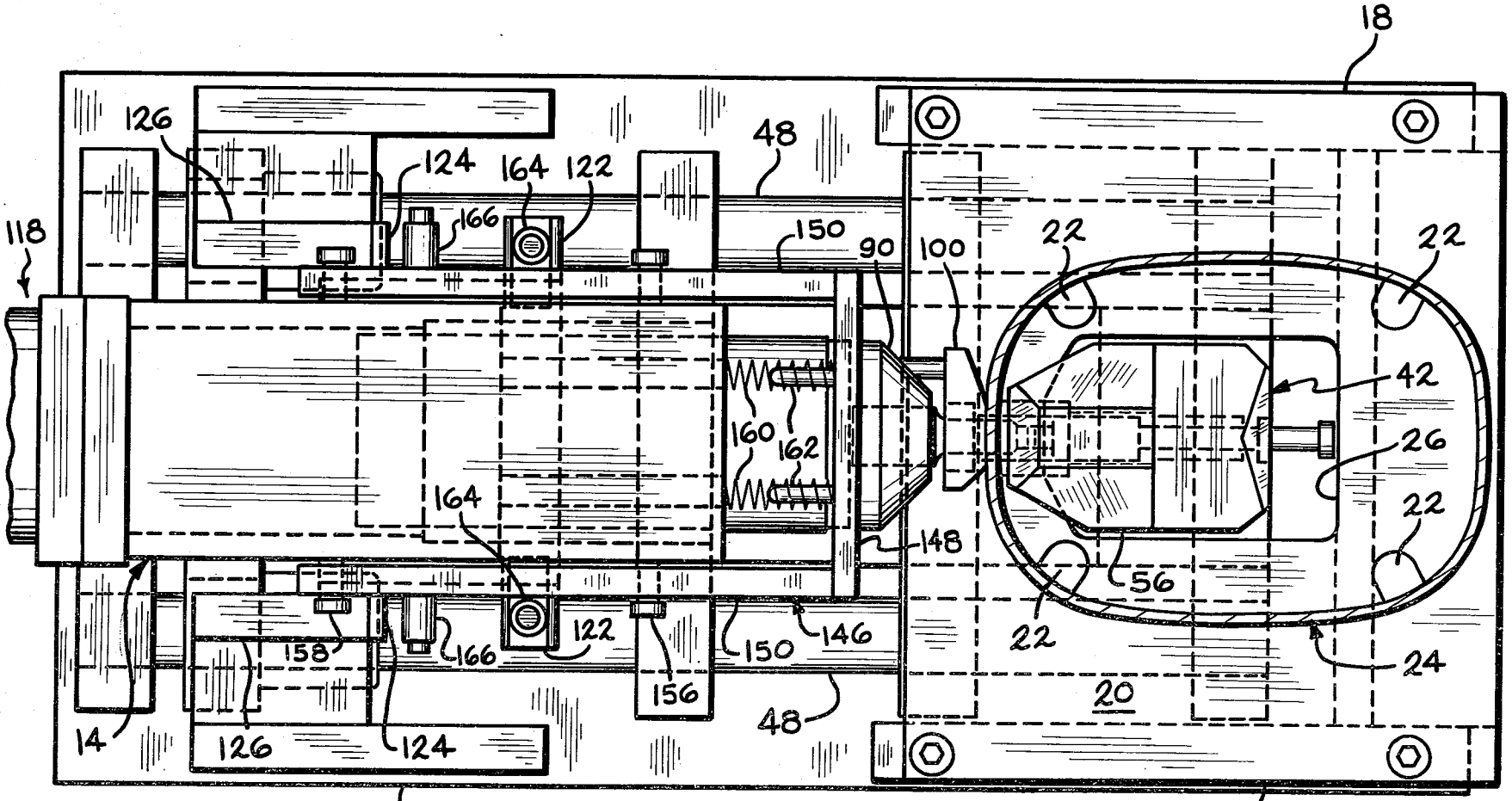
FIG. 2 is a bottom view of the apparatus of FIG. 1, but with a workpiece shown in cross section and a discharge chute removed.

Referring to the drawings, and particularly to FIGS. 1 and 2, piercing and flanging apparatus according to the invention is indicated at 10. The apparatus includes a main support 12 which slidably supports a main frame 14 and carries a workpiece support 16 in a fixed position. The support 16 includes two side plates 18 depending from the main support 12 and a positioning plate or table 20 which carries positioning posts 22. The posts 22 position a workpiece in the form of a heavy-duty compressor housing 24 under a central opening 26 in the platform 20. The housing 24 includes a side wall 28 in which is an opening 30 (FIG. 5) with an inwardly-extending annular flange 32 formed by the apparatus 10. The workpiece 24 is moved into position on the positioning post 22 by a suitable elevator 34 (FIG. 1) having a workpiece engaging member 36 and a ram 38.

The main frame 14 includes a main block 40 from which depend a leg or horn 42 and a bored block 44. The frame 14 is movably carried by the main support 12 and for this purpose, the main support has three depending legs 46 carrying a pair of guide rails 48. Two legs 50 having bushings 52 extend upwardly from the main block 40 of the frame 14 and slidably receive the rails 48. With this arrangement, the entire frame 14 can move in a lineal, horizontal path with the horn 42 moving back and forth in the opening 26 of the plate 20.

Figure 5:
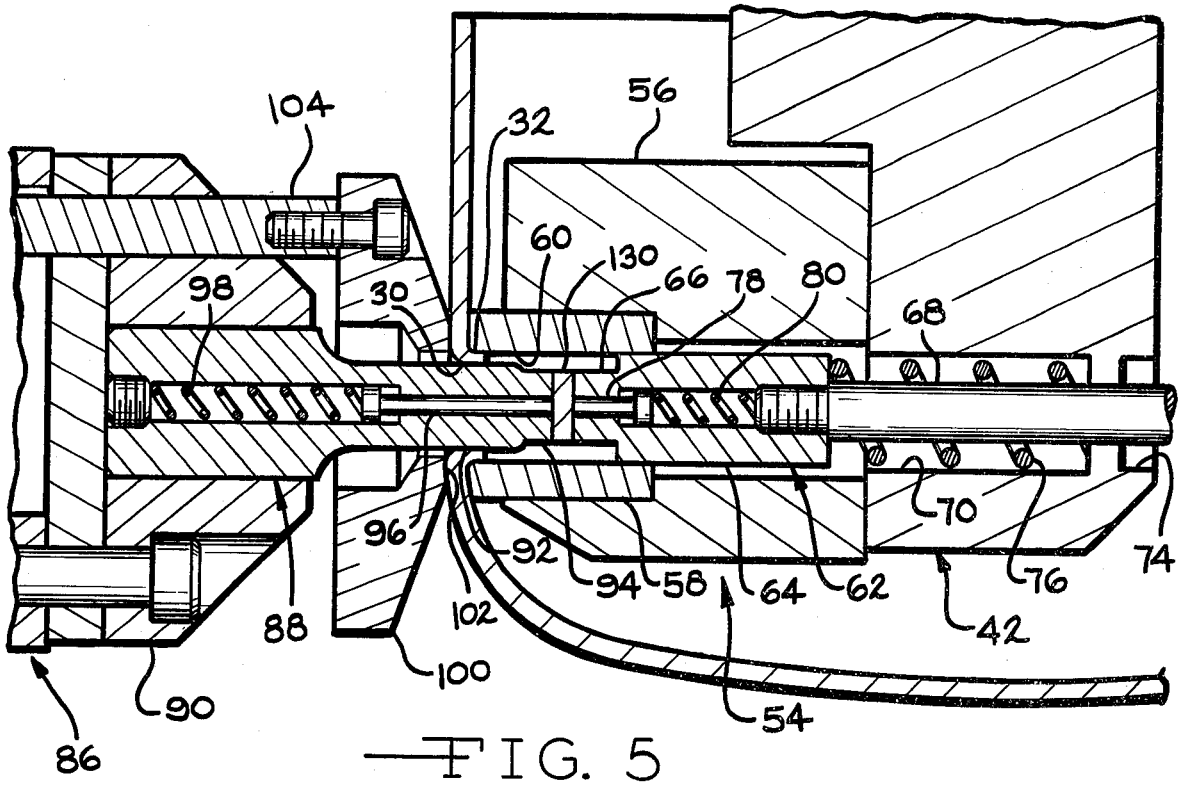
FIG. 5 is a fragmentary, further enlarged view in longitudinal cross section of a portion of the apparatus of FIG. 1.

Referring also to FIG. 5, the horn 42 carries a back-up die assembly 54 located within the workpiece 24 inside the side wall 28. The die assembly 54 includes a holding block 56 carrying a back-up die or die button 58 having central bore 60. A plunger 62 having a large cylindrical body 64 and a smaller diameter extension 66 extends into the bore 60. A stop rod 68 extends rearwardly from the body 64 through a chamber 70 to a head 72 located beyond a recess 74 in the horn 42. A spring 76 around the rod 68 seats against one end of the chamber 70 and an end of the body 64 of the plunger 62. The spring 76 thereby urges the plunger 62 toward the side wall 28 of the workpiece with the maximum position of the plunger in that direction being determined when the rod head 72 is in the recess 74. A shedder pin 78 is located in the plunger 62 and is urged outwardly beyond the extension 66 by an internal spring 80.

At the oposite end of the frame 14, the bored block 44 has a large cylindrical bore 82 with a bushing sleeve 84 in which is slidably carried a punch or die holder 86. A punch assembly including a punch 88 is located at the forward end of the holder 86 in a block 90 affixed thereto. The punch includes a cylindrical body 92 and a smaller diameter extension 94. The punch also carries a shedder pin 96 urged outwardly by a spring 98. The punch assembly also includes a stripper pad 100 which has an annular face 102 positioned around the punch 88. The pad is mounted on three rods 104 which extend through the block 90 and into a chamber 106 in the holder 86, with a spring 108 therein seated against an end of the chamber and against a plate 112 carried by the rods 104. The spring yieldably urges the stripper pad 100 outwardly toward the side wall 28 of the workpiece 24.

The punch 88 and the holder 86 are moved in the bore 82 by a piston rod 114 connected to the holder and extending outwardly from a cylinder 116 of a ram 118. The cylinder 116 is mounted by a plate 120 on the back of the bored block 44 of the frame 14.

Transverse stop pins 122 extend outwardly beyond the holder 86 and through side slots (not shown) in the bored block 44. The pins 122 limit the rearward movement of the holder 86 when they butt reaction stops 124 (FIGS. 1 and 2) carried by side plates 126 affixed to and depending from the main support 12. The maximum forward movement of the holder 86 is determined when the die button 88 is against the inner surface of the side wall 28 and the stripper pad 100 is against the outer surface of the side wall and also butts the front of the block 90.

A discharge chute 128 is positioned below the block 44 to receive a slug or piece 130 from the side wall 28. As shown in FIG. 1, the chute 128 includes a trough 132 having an end opening 134 to receive the slug 130. The trough also has an upwardly extending end 136 which helps direct the slugs into the opening 134. An air line 138 communicates with a nozzle 140 at the outer end of the chute 128, with air directed by the nozzle 140 down the trough from the line 138 to help move the slugs down the trough after being dropped therein.

Referring also to FIG. 2, the chute 128 has forward struts 142 and rear struts 144 which connect with a U-shaped frame 146. Specifically, the frame includes a transverse web 148 and legs or bars 150 which extend on each side of a lower portion of the bored block 44. The legs 150 have forward and rear slots 152 and 154 therein which receive forward and rear transverse pins 156 and 158 extending outwardly from and affixed to the block 44. The U-shaped frame 146 and the chute 128 are urged outwardly by springs 160 positioned on pins 162 and located between the web 148 of the frame 146 and a forward end of the bored block 44. The springs urge the chute outwardly toward a position under the side wall 28 of the workpiece 24, as shown in FIG. 1 when the block 44 is moved forwardly. In this position, the transverse pins 156 and 158 are at the rear ends of the slots 152 and 154. The chute then remains in this position until the holder 86 is retracted to the position of FIG. 6. At that time, vertical pins or rods 164 which extend downwardly from the transverse pins 122 engage transverse pins 166 which extend outwardly from the frame legs 150 and retract the frame 146 along with the chute 128 upon further retraction of the holder 86 to the position of FIG. 7. The chute 128 is thereby moved rearwardly to the position of FIGS. 3 and 7 where the chute is clear of the workpiece 24 so that it can be lowered by the elevator 34 and another put into position.

Figures 3, 4:
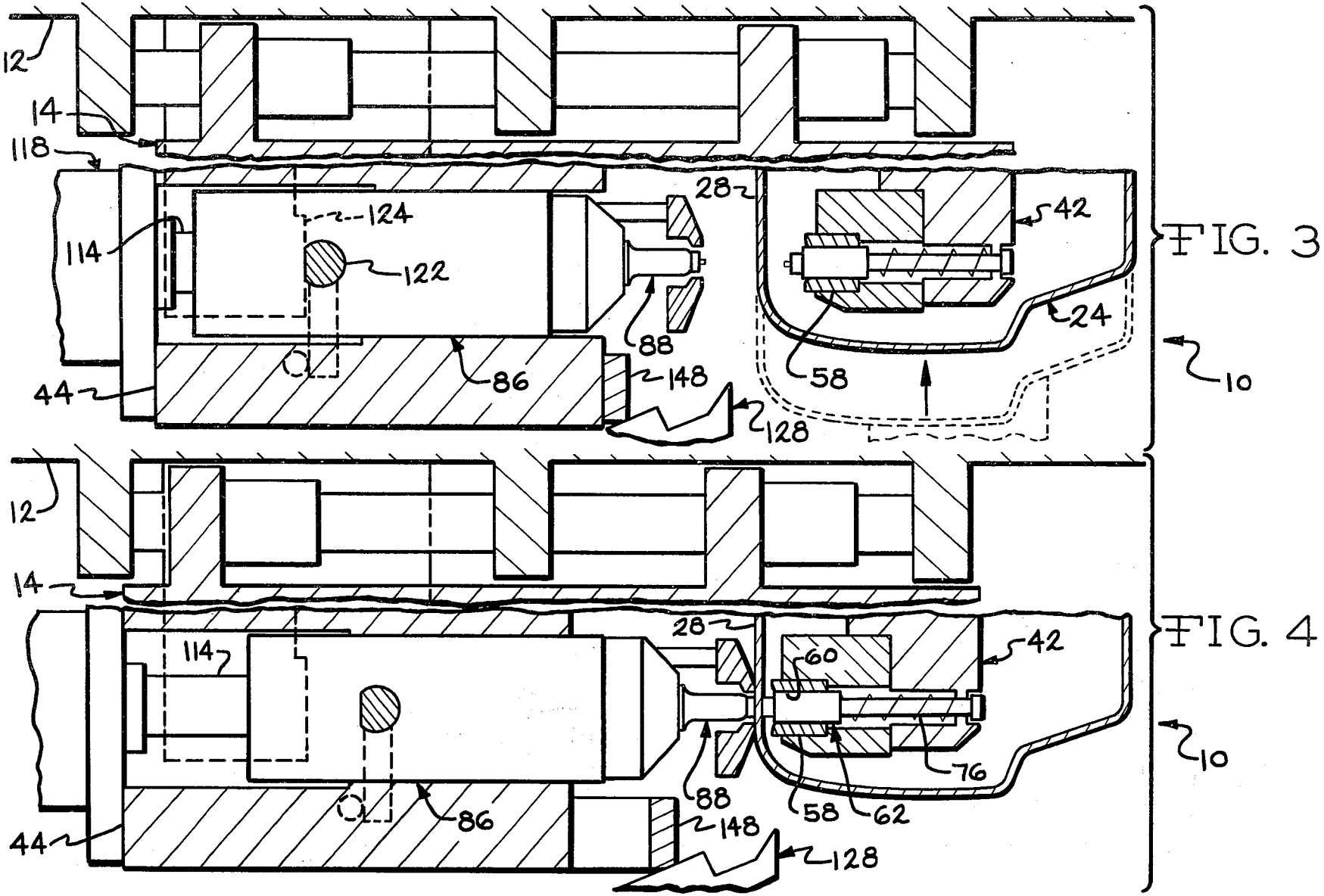
FIGS. 3 and 4 are somewhat schematic, fragmentary views in longitudinal cross section showing certain components of the apparatus in different positions.

While the operation of the apparatus 10 will be apparent from the above description thereof, an overall review of the operation of the apparatus will now be described, particularly with reference to FIGS. 3–7. Referring to FIG. 3, the piston rod 114 of the ram 118 is retracted along with the holder 86 until the transverse pins 122 abutt the reaction stops 124. After this contact, further retraction of the piston rod 114 causes the frame 14 to move toward the right to move the horn 42 and the die button 58 to the right to clear the side wall 28 of the workpiece 24. With the die button 58 and the punch 88 in these positions, the elevator 34 can move another one of the workpieces 24 into position, as indicated by the arrow.

With the next workpiece in position, the piston rod 114 is extended again, moving the holder 86 toward the right until the punch 88 contacts the side wall of the workpiece (FIG. 4). At this time, the punch 88 and the holder 86 can move no farther. Consequently, further extension of the piston rod 114 causes the main frame 14 to move toward the left along with the die button 58. As it does so, the plunger 62 is retracted into the passage 60, as the force of the spring 76 is overcome. The plunger is just beginning to retract in FIG. 4.

During the above-discussed movement of the punch 88 and the die button 58 between the positions of FIGS. 3 and 4, the discharge chute 128 moves toward the right to the outer receiving position of FIG. 4 along with the holder 86. After the punch 88 contacts the side wall 28 of the workpiece, as shown in FIG. 4, and the main frame 14 subsequently moves toward the left, the discharge chute 128 still remains in the outer, slug-receiving position because the springs 160 cause the web 148 of the frame 146 to separate farther from the end of the bored block 44.

After the piston rod 114 moves the die button 58 fully against the inner surface of the side wall 28 further extension of the piston rod causes the punch 88 to penetrate the side wall 28 (FIG. 5) and form an opening therein. The metal around the opening at this point is firmly held by the die button 58 and the stripper pad 100. The slug 130 is thereby formed and held between the end of the punch extension 94 and the end of the plunger extension 66. After this piercing operation, the punch moves further to cause the portion 92 of the punch to form the inwardly-extending flange 32 in the side wall 28 and to form the smooth opening 30 therein. As the punch 88 moves through the opening, the force of the spring 76 is overcome so that the plunger 62 moves rearwardly in the bore 60 of the die button 58

Figures 6, 7:
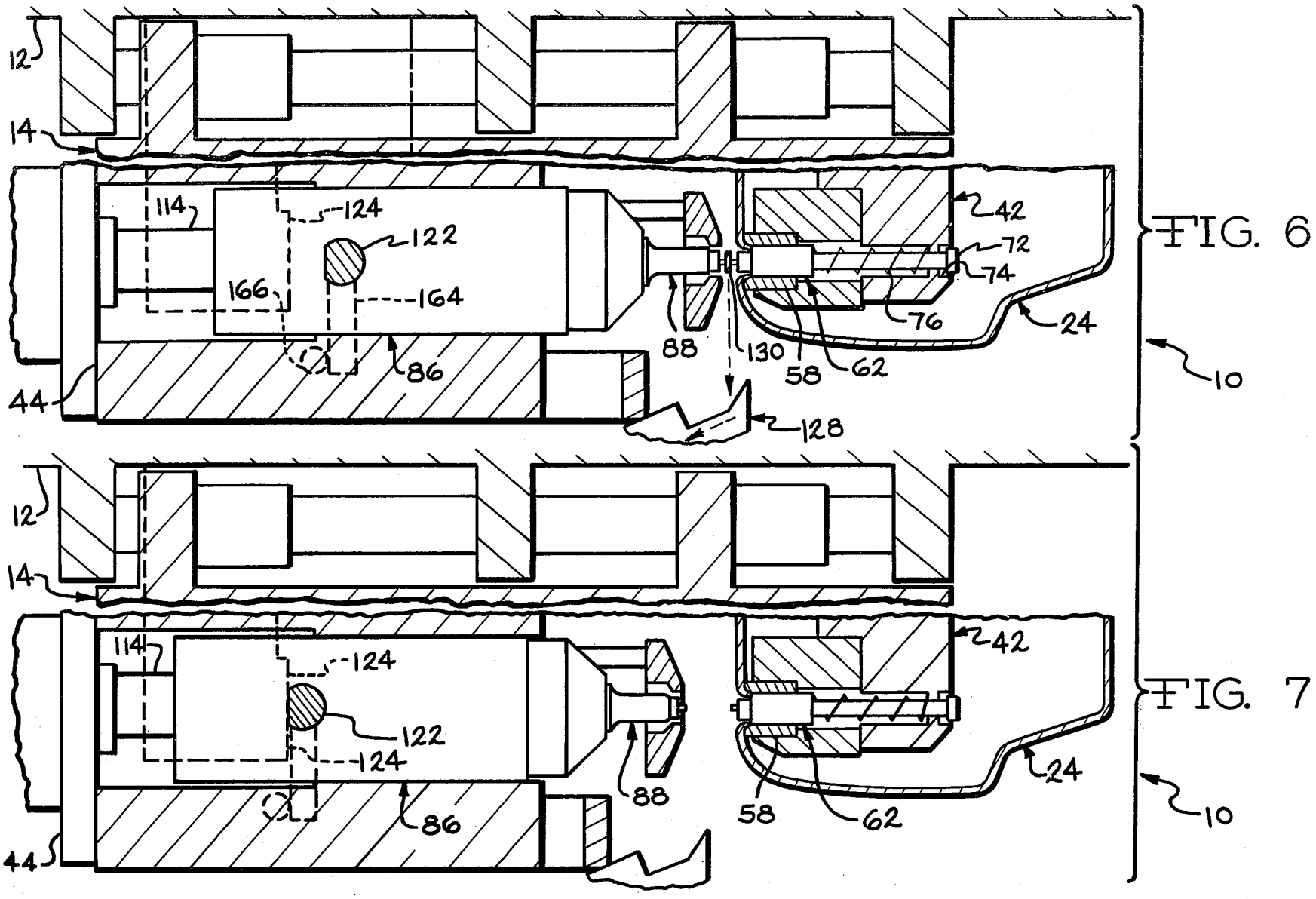
FIGS. 6 and 7 are views similar to FIGS. 3 and 4 showing the components in still different positions.

After the apparatus has completed the piercing and flanging operation and the components have moved approximately to the positions of FIGS. 1 and 5, the piston rod 114 is retracted into the cylinder 116. As this occurs, the punch 88 is retracted from the workpiece with the die button 58 remaining in contact therewith, as shown in FIG. 6. As the punch 88 is retracted, the plunger 62 moves forwardly through the die button 58 under the force of its spring 76. This action enables the slug 130 to remain held between the plunger and the punch until the plunger 62 reaches the forward end of its stroke. Further movement then finally separates the stripper pins 78 and 96 so that the slug 130 falls into the discharge chute 128. The chute remains in its extended slug-receiving position until the rods 164 contacts the transverse pins 166 again, this contact being initially made in FIG. 6.

Further retraction of the piston rod 114 moves the punch 88 to the position of FIG. 7 with the discharge chute 128 now similarly being retracted. At this point, the transverse pins 122 engage the reaction stops 124 to limit the rearward movement of the holder 86. Further retraction then causes the main frame 14 to move toward the right and move the die button 58 and the horn 42 back away from the side wall 28 to the position of FIG. 3. The workpiece can then be removed and another supplied to enable another piercing and flanging cycle to begin again.

Figure 8:
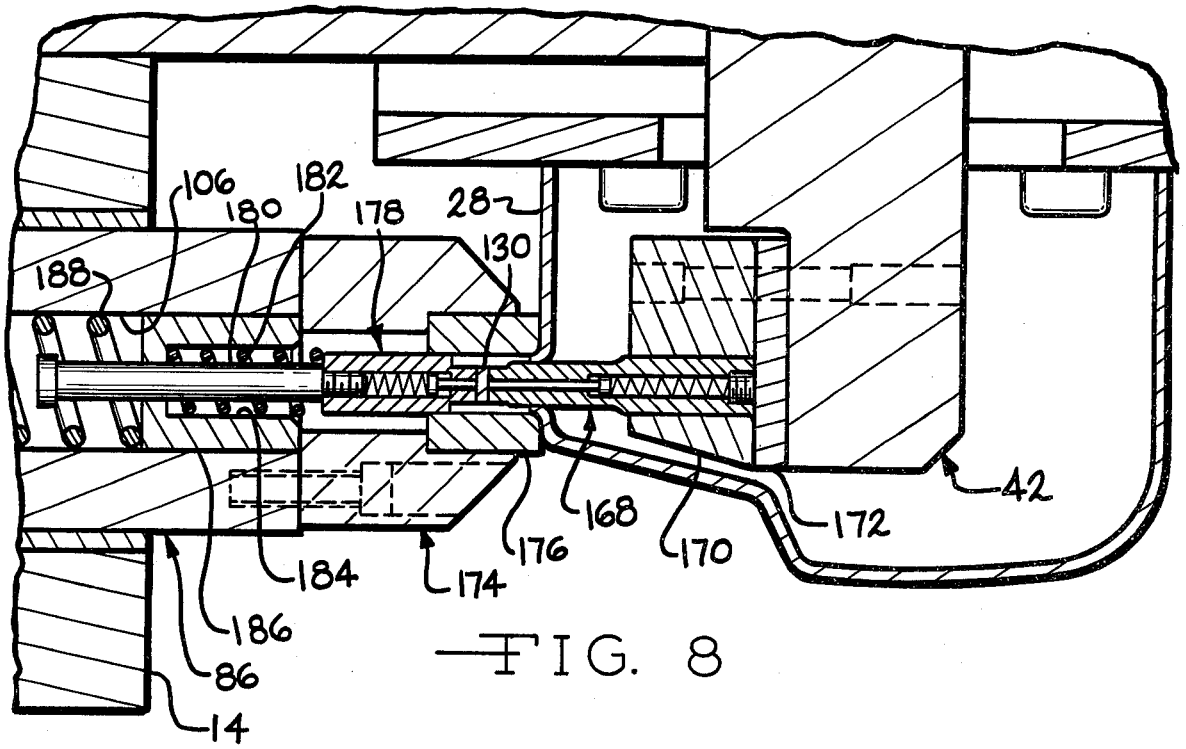
FIG. 8 is an enlarged, fragmentary view in longitudinal cross section similar to FIG. 5, showing the punch and die of the apparatus in reversed positions.

If desired, the apparatus 10 can be quickly adapted to piercing and flanging the workpiece 28 from the inside out, as shown in FIG. 8. In that instance, the die assembly 62 is replaced by s slightly modified punch 168 mounted on the horn 42 by a holder block 170 and a back-up plate 172. Mounted on the holder 86 in place of the punch assembly is a die assembly 174 which includes a die button or back-up die 176 similar to the die button 58, with a plunger 178 therein. The plunger 178 is similar to the plunger 62, having a rearwardly extending rod 180 with a spring 182 therearound in a chamber 184 of a metal insert 186 positioned in the chamber 106 of the holder 86. The insert is held in a forward position by a larger rear spring 188.

Operation of the modified apparatus is similar to that of the apparatus 10. The holder 86 is extened until the button 176 engages the outer surface of the side wall 28. At this time, the frame 14 moves toward the left, causing the punch 168 to engage and to pierce the side wall 28. When the piston rod is retracted, the die button 176 moves away from the workpiece with the slug 130 being held between the punch 168 and the plunger 178 until the plunger is clear of the die button 176 and the punch and plunger separate. The slug again then falls into the discharge chute. Further retraction of the piston rod causes the frame 14 to move toward the right and to retract the punch 168 from the side wall after the transverse pins of the holder 86 engage the reaction stops.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. Apparatus for piercing and flanging a workpiece, said apparatus comprising a support, means carried by said support for holding a workpiece, a frame carried by said support for movement along a path, a back-up die assembly, a punch assembly, said assemblies being carried by said frame with one being movable with respect thereto, a ram including a cylinder and a piston rod, one of said cylinder and rod being connected to said frame, and the other of said cylinder and said rod being connected to said movable assembly, said workpiece holding means being positioned to hold a portion of the workpiece between said punch assembly and said back-up die assembly, a discharge chute, means movably supporting said discharge chute by said frame, means for urging said discharge chute away from the portion of the frame which supports it and toward a position in which a portion of the discharge chute is below the workpiece, a holder for carrying said movable assembly, said holder having means for engaging said chute-supporting means for moving said discharge chute toward a retracted position away from the workpiece when said holder is moved away from the workpiece.

2. Apparatus according to claim 1 characterized by said punch assembly including a punch and a pad, and means for yieldably positioning said pad around said punch to engage the workpiece on the side thereof opposite said back-up die assembly.

3. Apparatus according to claim 1 characterized by said back-up assembly including a back-up die and a plunger movably mounted in said back-up die.

4. Apparatus according to claim 1 characterized by a reaction stop carried by said support, said engaging means of said holder also engaging said reaction stop when said holder is moved toward said stop by said ram to move said frame relative to said support.

5. Apparatus according to claim 1 characterized by said movable supporting means limiting the distance said discharge chute can move toward the workpiece and said engaging means of said holder being movable toward the workpiece with said holder a greater distance, whereby said engaging means of said holder will not engage said chute-supporting means when moving away from the workpiece until said holder is moved toward the retracted position a distance sufficiently great to release a slug removed from the workpiece.

6. Apparatus for performing work on a workpiece, said apparatus comprising a support, means mounted on said support for holding a workpiece, a frame movably carried by said support, a holder movably carried by said frame, drive means connected to said holder for moving said holder relative to said workpiece, a punch assembly, a back-up die assembly, one of said assemblies being mounted on said holder and the other of said assemblies being mounted on said frame, said assemblies being located on opposite sides of at least a portion of said workpiece, stop means connected to said support and engageable by said holder when in a given position relative to said workpiece support to cause said frame to move relative to said support, a discharge chute, means movably supporting said discharge chute from said frame for limited movement of said discharge chute in a direction generally parallel to the direction of movement of said holder, means for urging said discharge chute toward a position in which a portion of the discharge chute is below the workpiece, and means carried by said chute-supporting means for moving said discharge chute toward a retracted position away from the workpiece when engaged by means carried by said holder.

7. Apparatus according to claim 6 characterized by said drive means comprising a ram including a cylinder mounted on said frame and a piston rod connected to said holder.

8. Apparatus according to claim 6 characterized by said means carried by said holder also engages said stop means, said means carried by said holder engaging said means carried by said chute-supporting means to retract said chute prior to said holder means engaging said stop means when said holder is moved by said drive means away from the workpiece.

9. Apparatus according to claim 8 characterized by said movable supporting means for said discharge chute enabling the distance said chute means toward said workpiece to be less than the distance said holder moves toward the workpiece, whereby when said holder is retracted from said workpiece, said means carried by said holder will not engage said means carried by said chute-supporting means until a slug removed from the workpiece is released by said punch assembly and said back-up die assembly.

* * * * *

UNITED STATES PATENT OFFICE

CERTIFICATE OF CORRECTION

PATENT NO. : 4,073,176

DATED : February 14, 1978

INVENTOR(S) : William A. Paul

It is certified that error appears in the above-identified patent and that said Letters Patent are hereby corrected as shown below:

Column 1, line 42, charge "," to --;--.

Line 59, for "extened" substitute --extended--.

Column 6, line 43, for "means" substitute --moves--.

Signed and Sealed this

Sixth Day of June 1978

[SEAL]

*Attest:*

RUTH C. MASON
*Attesting Officer*

DONALD W. BANNER
*Commissioner of Patents and Trademarks*